United States Patent [19]

Grosser et al.

[11] 4,275,882

[45] Jun. 30, 1981

[54] HOME EXERCISE GYM

[75] Inventors: Richard W. Grosser, Boone; Virgil L. Long, Sr., Jefferson, both of Iowa

[73] Assignee: AMF Incorporated, White Plains, N.Y.

[21] Appl. No.: 134,720

[22] Filed: Mar. 27, 1980

[51] Int. Cl.[3] ..... A63B 21/08; A63B 23/02

[52] U.S. Cl. ..... 272/117; 272/130

[58] Field of Search ..... 272/117, 118, 130, 134, 272/136, 138, 141, 142

[56] References Cited

U.S. PATENT DOCUMENTS

| | | | |
|---|---|---|---|
| 3,638,941 | 2/1972 | Kulkens | 272/130 |
| 3,971,555 | 7/1976 | Mahnke | 272/118 |
| 4,066,259 | 1/1978 | Brentham | 272/130 |

FOREIGN PATENT DOCUMENTS

| | | | |
|---|---|---|---|
| 40866 | 10/1973 | Australia | 272/134 |
| 650009 | 2/1951 | United Kingdom | 272/130 |

*Primary Examiner*—Richard J. Johnson

*Attorney, Agent, or Firm*—George W. Price; Walter Lewis

[57] ABSTRACT

A hydraulic shock absorber has an adjustable connection to the exercise lever to provide variable resistive forces to exercise, and alternately the shock can be mounted to the exercise lever as a dead weight and a pulley-cord system added, so that a multiplicity of exercises can be performed with the same basic unit.

4 Claims, 6 Drawing Figures

HOME EXERCISE GYM

This invention relates to an exerciser, and more particularly to a multi-purpose exerciser which can be readily installed in the home to serve as a home exerciser gym.

Briefly, although the exerciser can be adapted to be free standing, in the illustrated form of the invention it is mounted on a frame which can be readily mounted on the wall of a home at the 16" spaced centers of adjacent wall studs. The unit is low cost in that it uses a relatively small number of parts considering the multiplicity of exercises for which it can be set up or adapted. For example, it can be adapted to do lever exercises or pull cord exercises, and free standing exercises and also bench exercises. One or more piston-cylinder type shock absorbers are used, preferably the hydraulic type, to provide hydraulic resistive forces to exercise. This is mounted on the wall frame and adjustably connected to the exercise lever so that the resistive forces can be readily varied. In addition, the same shock absorbers can be disconnected from the wall frame and mounted to the exercise lever to serve as dead exerciser weights and a pulley-cord system connected up to the device to do pull cord exercises.

The invention will be best understood by considering the following detailed description taken in combination with the accompanying sheets of drawings in which.

Figure 1:
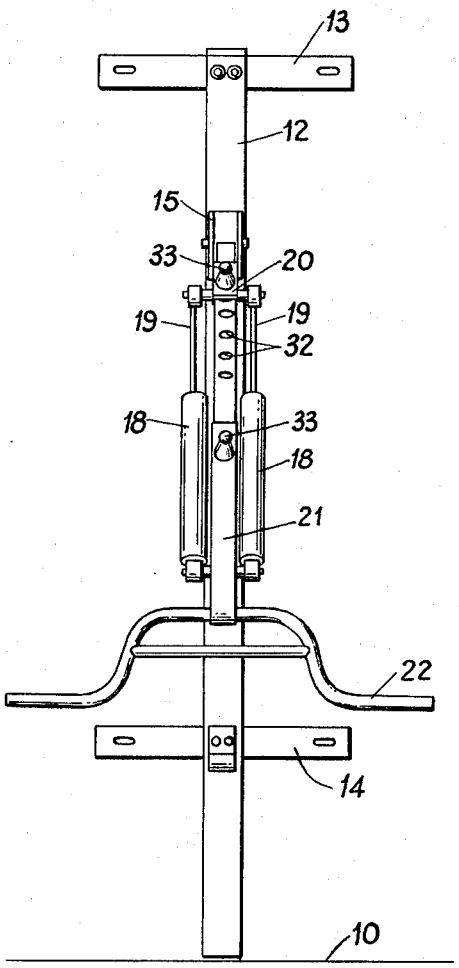
FIG. 1 is a front elevation view of the basic exercise unit and FIG. 2 is a side elevation view thereof.
Figure 2:
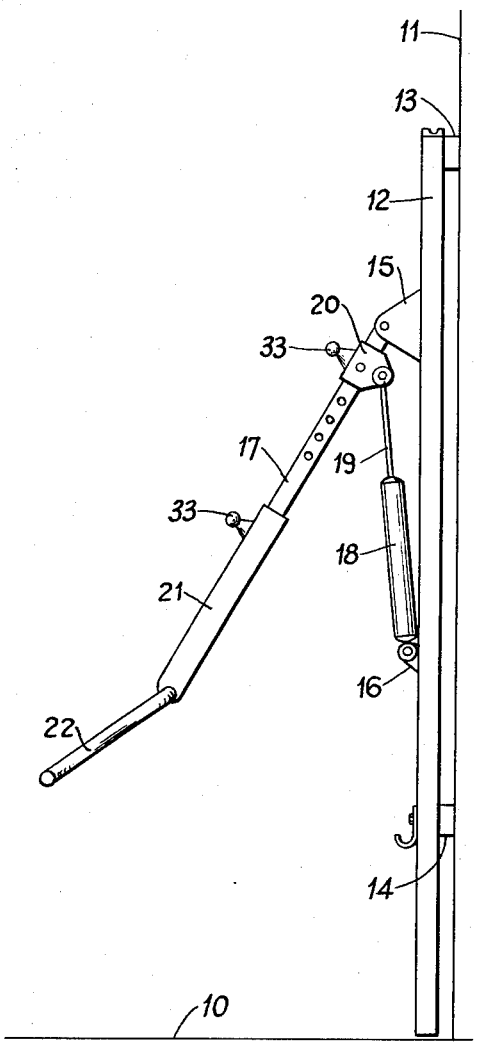

Turning now first to FIGS. 1 and 2, line 10 indicates a floor surface, and line 11 indicates a wall surface. The exerciser has a main vertical frame member 12 having top and bottom cross members 13 and 14. The ends of cross members 13 and 14 are apertured on 16" spaced centers so that the unit can be readily fastened to adjacent wall studs of conventional homes.

Top and bottom brackets 15 and 16 are mounted on the frame 12. An exercise lever 17 is pivoted to bracket 15 and a hydraulic piston-cylinder type shock absorber, which can be an automotive one, is pivoted to bracket 16. As shown, its 18 cylinder is pivoted to bracket 16, and the outer end of its piston rod 19 is pivoted to lever 17 at a bracket 20 on the lever 17. Bracket 20 is adjustable along the length of the lever 17. This means that the point of pivotal connection of the shock 18, 19 to the exercise lever 17 can be readily varied. Therefore, the resistive forces to movement of lever 17 can be readily varied depending upon the location of the bracket 20 on lever 17. The further the bracket 20 is moved out along lever 17 the harder it is to move the lever 17 against the hydraulic resistive forces of the shock 18, 19.

An adapter handle is connected to the outer end of lever 17 comprising a sleeve 21 adjustably connected to lever 17 and a handle bar 22 having spaced end hand grips. Although only a single shock 18, 19 has been described it will be seen from the drawings that two can be used also, and they can be of equal or different strength to be able to get a very wide range of resistive force.

Figure 3:
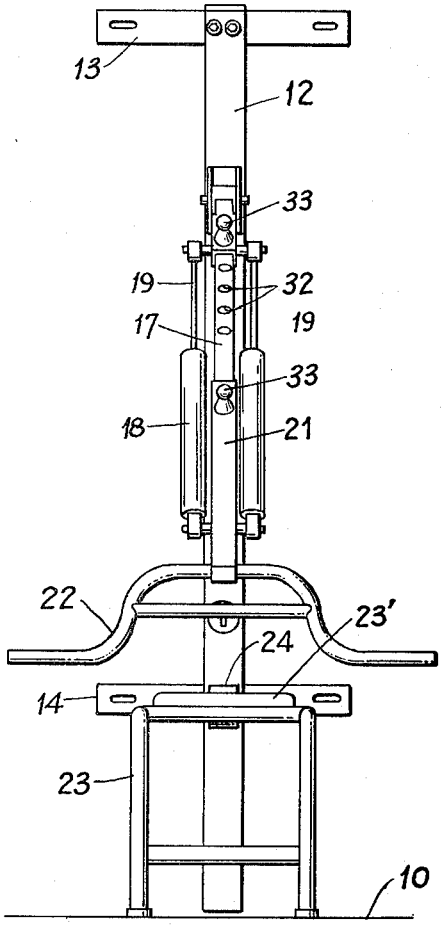
FIGS. 3 and 4 are front and side elevation views of the same basic unit adapted for bench type exercises.
Figure 4:
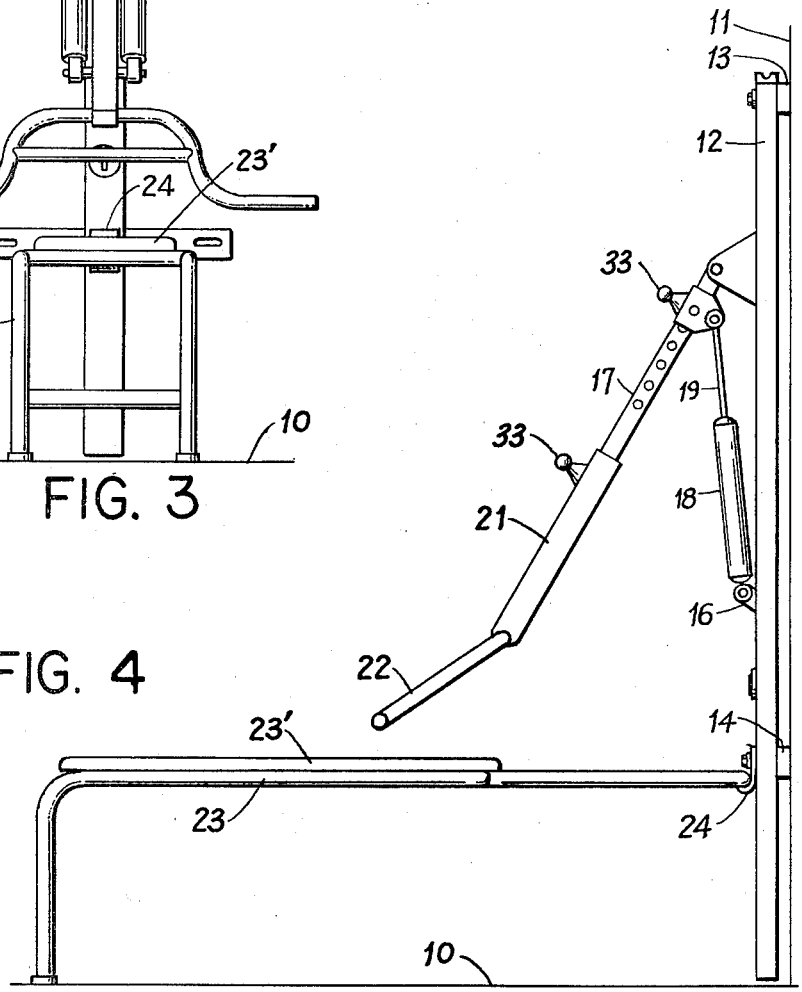

Turning now to FIGS. 3 and 4, shown therein is the same basic unit of FIGS. 1 and 2 with an exerciser bench added. The bench comprises an L-shaped frame 23, one end of which stands on floor 10 and the other end of which is supported by the vertical frame 12 off a hook 24 mounted thereon. The L-shaped frame 23 is provided with a padded seat 23' on which the user can sit or lie down while exercising by pushing, pulling or lifting on the handle bar 22. By comparison, when the user is exercising with the FIGS. 1 and 2 arrangement he is standing in front of the unit either facing the frame 12 or with his back to it, depending on the kind of exercise he is doing.

Figure 5:
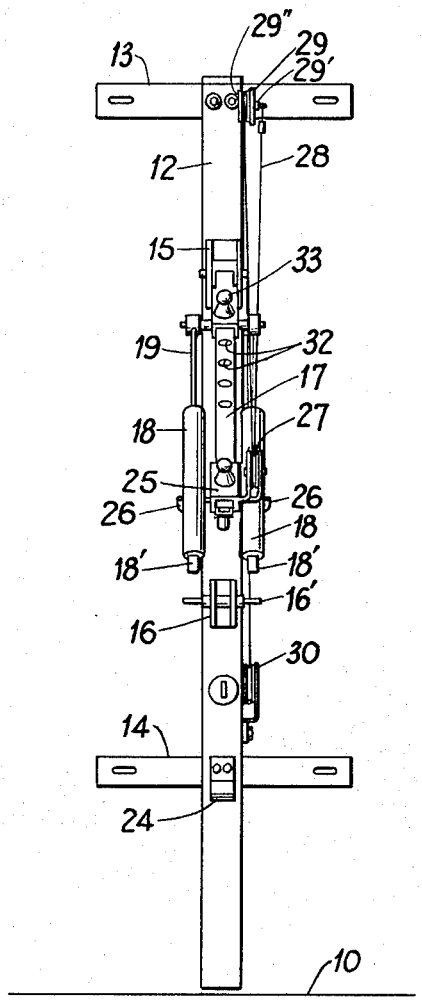
FIGS. 5 and 6 are front and side elevation views of the same basic unit adapted for pull-cord type exercises.
Figure 6:
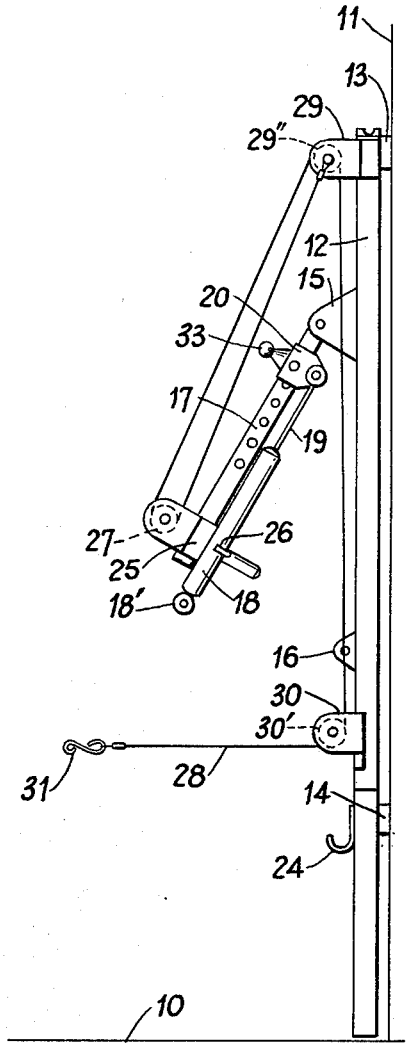

Turning now to FIGS. 5 and 6, in this arrangement the basic unit of FIGS. 1 and 2 is still being used but the shocks 18, 19 are being used as dead weight and a pulley-cord system has been added with which to pull on the main exercise lever 17. As shown, the bottom of the cylinder 18 has had its eye 18' disconnected from the pivot pin 16' of the bottom bracket 16. The shock 18, 19 has been swung up to the exercise lever 17 to be generally parallel therewith. The handle adapter sleeve 21 of FIGS. 1–4 has been taken off the lever 17 and replaced by an adaptor 25 having a pair of cradles 26 for the shocks and a pulley 27 for an exerciser cord 28. The shocks are nested in the cradles 26 to be in parallel with the lever 17. Pulley brackets 29 and 30 are added to the upper and lower portions of the vertical frame 12. The upper end of the cord or cable 28 is dead ended to the upper end of the frame 12 at the pivot pin 29' of a pulley 29" in the bracket 29. From there the cord 28 progresses down to and around pulley 27 on the adapter 25 and then back up to the bracket 29 and around pulley 29". From pulley 29" the cord runs down to the bracket 30 and around a pulley 30' thereat to out in front of the exerciser unit. The outer lower end of the cord or cable 28 has a closed S-shaped fitting 31 thereon to which can be attached, a not shown bar or hand grip, as may be desired, depending upon the type of exercise to be done. Of course the FIGS. 5 & 6 arrangement can be used with an exercise bench as in the FIGS. 3 and 4 set-up.

It should be noted that the main exerciser lever 17 has a series of holes 32 formed therein adjacent to the adapter 20 and the latter is provided with a spring biased plunger 33. So, the adapter 20 can be selectively adjusted along the length of lever 17 and its position held set by the plunger 33 entering one of the holes 32. As before stated, this is for the purpose of adjusting the point at which the shocks are pivot connected to the lever 17 to adjust the resistive force. By viewing each form or modification of the invention shown in FIGS. 1, 2 and 3, 4 and 5, 6 it will be seen that the adapters 21 and 25 are provided with similar adjusting means. This is for the purpose of making the handle 21, 22 shorter or longer, and for purposes of moving the dead weight shocks in or out along the length of lever 17 to vary the resistive force of the dead weight shocks.

Now that there has been described one form of the invention it will be seen that it is a relatively low cost and minimum parts one considering the different ways in which it can be used, and without any particularly esoteric parts being required. The basic unit can be sold as shown in FIGS. 1 and 2, or with a bench as in FIGS. 3 and 4, or with the necessary parts to adapt the unit to be like FIGS. 5 and 6, or just like FIGS. 5 and 6 but without the handle 21, 22 of FIGS. 1 and 2, depending upon the wishes of the purchaser. In any event, considering the total disclosure, if all the necessary adapters are provided the purchaser will be provided with a device with which he can perform a great many different exercises, in fact, almost all the standard known ones. And, considering that the unit can be readily installed in the home, the invention provides what in fact is almost a complete home exercise gym. Of course, because the point of pivotal connection of the shocks to the lever 17 can be adjusted, as well as the position of the dead weight of the shocks along the length of the lever 17, it is easy to make selective adjustments. And, this is without any loose or falling parts and without the need to add or subtract weights as in many prior art exercisers.

We claim:

1. An exercise device comprising a vertical frame, a manually operable exercise lever pivoted at its inner end to said frame, a piston-cylinder hydraulic type shock absorber having a pivot connection at one of its ends to said frame and at its other end to said lever, means for adjusting said other end pivot connection along the length of said lever to vary the resistive force of said shock absorber to movement of said lever, and said one end pivot connection being disengagable from said frame and a cradle on the said lever for retaining said shock absorber solely on said lever whereby said shock absorber operates as a dead weight resistive force to movement of said lever.

2. In a exercise device as in claim 1, said hydraulic shock absorber being arranged whereby when said shock absorber one end is pivoted to said frame said shock absorber imposes a hydraulic resistive force to movement of said lever, and a pulley cable connected to said lever to manually operate the same in either stated position of said shock absorber.

3. In an exercise device as in claim 2, said frame having top and bottom cross members, and holes in opposite ends of said cross members spaced from each other on 16" centers whereby said device can be mounted on a house wall on adjacent spaced wall studs.

4. In an exercise device as in claim 3, a hook on the lower end of said frame which is adapted to have one end of an L-shaped bench hooked thereon in position beneath said lever, and the outer end of said lever being adapted to receive an adjustable extension handle thereon having a pair of laterally spaced hand grips.

* * * * *